US008439135B2

(12) United States Patent
Lyon et al.

(10) Patent No.: US 8,439,135 B2
(45) Date of Patent: May 14, 2013

(54) DOWN-THE-HOLE DRILL HAMMER HAVING AN EXTENDABLE DRILL BIT ASSEMBLY

(75) Inventors: Leland H. Lyon, Roanoke, VA (US); Warren Thomas Lay, Catawba, VA (US)

(73) Assignee: Center Rock Inc., Berlin, PA (US)

( * ) Notice: Subject to any disclaimer, the term of this patent is extended or adjusted under 35 U.S.C. 154(b) by 0 days.

(21) Appl. No.: 13/078,517

(22) Filed: Apr. 1, 2011

(65) Prior Publication Data

US 2011/0240373 A1 Oct. 6, 2011

Related U.S. Application Data

(60) Provisional application No. 61/319,957, filed on Apr. 1, 2010.

(51) Int. Cl.
*E21B 10/40* (2006.01)

(52) U.S. Cl.
USPC ..... 175/407; 175/272; 175/286; 175/295

(58) Field of Classification Search ..... 175/257, 175/258, 259, 260, 261, 272, 273, 286, 295, 175/406, 407
See application file for complete search history.

(56) References Cited

U.S. PATENT DOCUMENTS

| | | | | |
|---|---|---|---|---|
| 165,787 | A * | 7/1875 | Bullock | 175/272 |
| 261,565 | A * | 7/1882 | Reichardt | 175/273 |
| 1,569,262 | A | 1/1926 | Calahan | |
| 1,578,623 | A | 3/1926 | Zublin | |
| 1,743,528 | A | 1/1930 | Campbell | |
| 1,834,337 | A | 12/1931 | Crum | |
| 1,858,926 | A | 5/1932 | Grau | |
| 1,899,727 | A | 2/1933 | Sandstone | |
| 2,705,129 | A | 3/1955 | Menton | |
| 4,031,972 | A | 6/1977 | Burg | |
| 4,458,761 | A | 7/1984 | Van Vreeswyk | |
| 4,915,181 | A | 4/1990 | Labrosse | |
| 5,010,967 | A * | 4/1991 | Desai | 175/406 |
| 5,148,875 | A | 9/1992 | Karlsson et al. | |
| 5,207,283 | A | 5/1993 | Lay | |
| 5,881,827 | A | 3/1999 | Ikeda et al. | |
| 6,394,197 | B1 * | 5/2002 | Holte | 175/273 |
| 6,427,788 | B1 | 8/2002 | Rauchenstein | |
| 7,143,847 | B2 | 12/2006 | Pia | |
| 7,195,085 | B2 | 3/2007 | Pia | |

(Continued)

OTHER PUBLICATIONS

Int'l Search Report issued Sep. 28, 2011 in Int'l Application No. PCT/US2011/030916; Written Opinion.

*Primary Examiner* — William P Neuder
*Assistant Examiner* — Robert E Fuller
(74) *Attorney, Agent, or Firm* — Kim Krizman LLC

(57) ABSTRACT

A down-the-hole drill hammer assembly includes a casing, a drill stem, a drilling lug segment and a pilot drill bit is provided. The drill stem is housed within the casing and includes an abutment surface. The drilling lug segment is slidably engaged with a distal end of the drill stem and movable between an initial configuration and an extended configuration. The drilling lug segment includes a proximal end engageable with the abutment surface of the drilling lug segment. The drill stem is movable between first and second positions within the pilot drill bit. In moving to the second position, the drill stem slidingly engages the drilling lug segment and moves the drilling lug segment to the extended configuration.

20 Claims, 10 Drawing Sheets

U.S. PATENT DOCUMENTS

| | | | | |
|---|---|---|---|---|
| 7,293,616 | B2 | 11/2007 | Tulloch | |
| 7,370,712 | B2 | 5/2008 | Stout et al. | |
| 7,410,015 | B2 | 8/2008 | Denoix | |
| 7,451,836 | B2 | 11/2008 | Hoffmaster et al. | |
| 7,451,837 | B2 | 11/2008 | Hoffmaster et al. | |
| 7,493,971 | B2 | 2/2009 | Nevlud et al. | |
| 7,506,703 | B2 | 3/2009 | Campbell et al. | |
| 7,681,667 | B2 | 3/2010 | Pia | |
| 7,775,303 | B2 * | 8/2010 | Goting | 175/389 |
| 2003/0183424 | A1 | 10/2003 | Tulloch | |
| 2006/0096785 | A1 | 5/2006 | Walter et al. | |
| 2007/0144787 | A1 | 6/2007 | Pia | |
| 2008/0251294 | A1 | 10/2008 | Minshull | |
| 2009/0188719 | A1 * | 7/2009 | Lim | 175/57 |
| 2009/0314548 | A1 | 12/2009 | Fanuel et al. | |
| 2010/0059284 | A1 | 3/2010 | Lyon et al. | |
| 2010/0187017 | A1 | 7/2010 | Lyon | |

* cited by examiner

DOWN-THE-HOLE DRILL HAMMER HAVING AN EXTENDABLE DRILL BIT ASSEMBLY

CROSS-REFERENCE TO RELATED APPLICATIONS

This application is entitled to and claims the benefit of the priority pursuant to 35 U.S.C. §119(e) of U.S. Provisional Patent Application No. 61/319,957, filed Apr. 1, 2010, the entire disclosure of which is hereby incorporated herein by reference.

BACKGROUND OF THE INVENTION

The present invention relates to a type of down-the-hole percussive drilling hammer having a drilling bit with the ability to drill a hole with one outer diameter and then reduce its overall outer diameter for extraction from the hole through a pipe or casing that is inserted while the hole is being drilled. Insertion of a pipe into the ground is a common practice for many types of construction projects. For example, water wells use a casing for sealing contaminated surface water from potable deeper water. Sometimes the casing is only installed by under-reaming to prevent the hole from caving or collapsing into itself. Foundations commonly use a process called micropiling where a series or collection of smaller pipes are under-reamed into the ground and secured in place to create a larger foundation structure. In all applications, these products are known as under reamers.

There are many styles and types of available under reamers. Concentric systems typically use a "lost crown" or "ring bit" to create a kerf for the casing. While such systems are effective, they are costly to use for micropiling since the kerf-cutting ring bit is left (i.e., discarded) in the hole and because of the high number of piles associated with micropiling. Eccentric systems typically use a hinged wing or segment that rotates away or toward the pilot bit to create a kerf for casing clearance. Such systems have the operating cost advantage of not leaving a ring bit in the hole, but they do have operational limitations. For example, the hinged wing is rotated and held outward by a clockwise torque requiring contact with the borehole. If borehole contact is lost, it is likely that the wing will not stay in position, thus leaving an undersized hole through which the casing will not fit.

Regarding lug based systems, such lug systems use a series of radially extendable lugs. For example, in one prior art device, lugs are extended radially outwardly by making contact with the base of the borehole. A known limitations of such lugs is that they require constant contact with the bore hole bottom to remain in the extended configuration. Therefore, if the ground surface cannot supply ample back pressure to extend the lugs (such as when advancing through sand, voids or other similar conditions) the system will drill an undersized hole that will not allow the casing to clear the hole.

Therefore, it would be desirable to have a percussive down-the-hole drill hammer under reaming system that addresses the foregoing limitations of conventional down-the-hole under reamers.

BRIEF SUMMARY OF THE INVENTION

In accordance with the present invention, the problem of cost-effective and reliable under reaming operations is solved by engendering a drill bit assembly for a percussive down-the-hole drill hammer having extendable drill bits to enlarge its cutting face diameter. The extendable drill bits are extended upon full engagement of a drill stem with a pilot drill bit. In this way, a simple and reliable drill bit is provided that can effectively and efficiently perform under reaming operations.

In accordance with a preferred embodiment of the present invention, a down-the-hole drill hammer assembly includes a housing, a drill stem, a drilling lug segment and a pilot drill bit. The drill stem is at least partially housed within the housing and including an abutment surface. The drilling lug segment is slidably engaged with a distal end portion of the drill stem and movable between an initial configuration and an extended configuration. The drilling lug segment includes a proximal end that engages with the abutment surface of the drilling lug segment. The pilot drill bit is mounted to a distal end portion of the drill stem and includes an open proximal end for receiving a portion of the drill stem, and a lateral wall that includes an opening having the drilling lug segment positioned therein. The drill stem is movable between first and second positions within the pilot drill bit. In moving to the second position, the drill stem moves the drilling lug segment to the extended configuration.

In accordance with another preferred embodiment of the present invention, an extendable drill bit assembly includes a pilot drill bit and a drilling lug segment. The pilot drill bit is for mounting to a drill stem. The pilot drill bit includes a cylindrical body, an open proximal end and a hollow interior for receiving a distal end segment of the drill stem. The pilot drill bit also includes a thrust surface proximate the open proximal end and a distally facing wall segment having a plurality of cutting inserts and a proximally facing inner surface. A lateral wall extends between the thrust surface and the distally facing wall segment. The lateral wall has an opening partially formed by the proximally facing inner surface and a sloped surface that is sloped relative to a longitudinal axis of the pilot drill bit. The drilling lug segment is partially housed within the opening and moveable between a first position substantially within the pilot drill bit and a second position extending radially outwardly through the opening of the lateral wall of the pilot drill bit. The drilling lug segment includes a curved distally facing surface slidably engaged with the proximally facing inner surface of the distally facing wall segment, a proximal end portion having a convex apex thrust surface for engaging a thrust shoulder of the drill stem, and a correspondingly sloped proximal surface that engages the sloped surface of the opening of the lateral wall.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
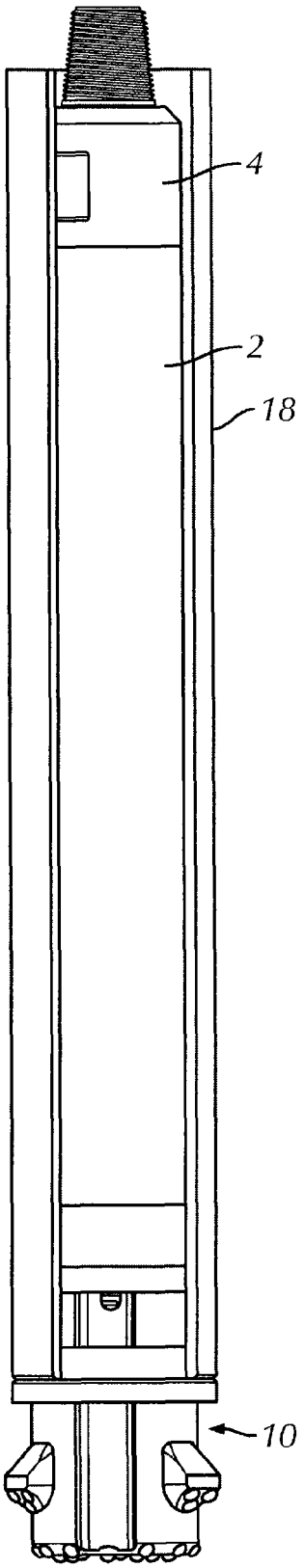
FIG. 1 is a side elevational view of a down-the-hole drill (DHD) hammer assembly in accordance with a preferred embodiment of the present invention along with a partial cut away view of a casing.
Figure 1A:
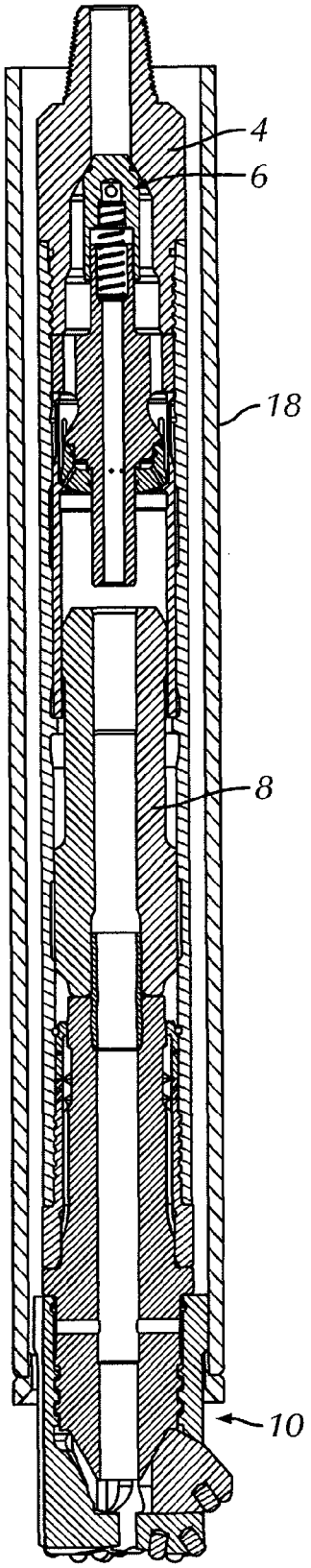
FIG. 1A is a side cross-sectional elevational view of the DHD hammer assembly and casing of FIG. 1.

Reference will now be made in detail to the present embodiment of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. The words "proximal" and "distal" refer to directions toward and away from, respectively, the geometric center of the identified element and designated parts thereof. The term "distal" also means towards the drill bit end of the DHD hammer, while the term "proximal" also means towards the backhead end of the DHD hammer. Such directional terms used in conjunction with the following description of the drawings should not be construed to limit the scope of the invention in any manner not explicitly set forth. Additionally, the term "a," as used in the specification, means "at least one." The terminology includes the words noted above, derivatives thereof and words of similar import.

In a preferred embodiment, the present invention provides for a percussive down-the-hole drill hammer assembly that includes a housing 2, a backhead 4, a check valve assembly 6, a piston 8 and an extendable drill bit assembly 10. The backhead 4 is connected to a proximal end of the housing and connects to a drill string (not shown). The check valve assembly 6 is housed within the backhead for regulating the flow of high pressure supply feed (e.g., air) to the DHD hammer's interior. The piston 8 is mounted within the housing and configured to percussively move within the housing as a result of the high pressure feed entering the hammer's drive and return chambers through the hammer's porting system. The percussive movement of the piston within the DHD hammer strikes a thrust surface of the extendable drill bit assembly to effectuate drilling operations. The structure and operation of the housing, backhead, check valve, piston, and porting system are known in the art and therefore a detailed description of them is not necessary for a complete understanding of the present invention. However, a description of exemplary down-the-hole percussive drill hammers is disclosed in U.S. Patent Application Publication No. 2010/0187017 and U.S. Pat. No. 5,207,283, the entire disclosures of which are hereby incorporated herein by reference in their entirety.

The DHD hammer assembly of the present invention is configured for under reaming operations. In under reaming operations, a casing 18 is inserted in the bore hole. Thus, the extendable drill bit assembly 10 of the DHD hammer is passed through the casing 18 and beyond the distal or bottom end of the casing to effectuate drilling. The casing 18 can include a casing shoe 18' that is attached to or formed integrally with the distal end of the casing. Hereinafter, the casing 18 and casing shoe 18' will be collectively be referred to as the casing.

Figure 2:
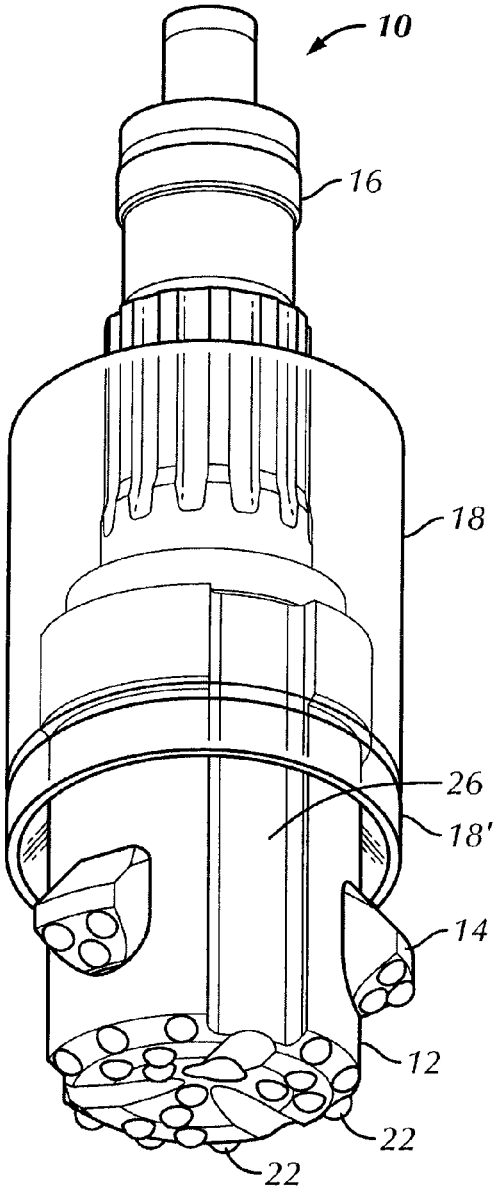
FIG. 2 is a perspective view of a drill stem and an extendable drill bit assembly in an extended configuration of the DHD hammer assembly of FIG. 1.
Figure 3:
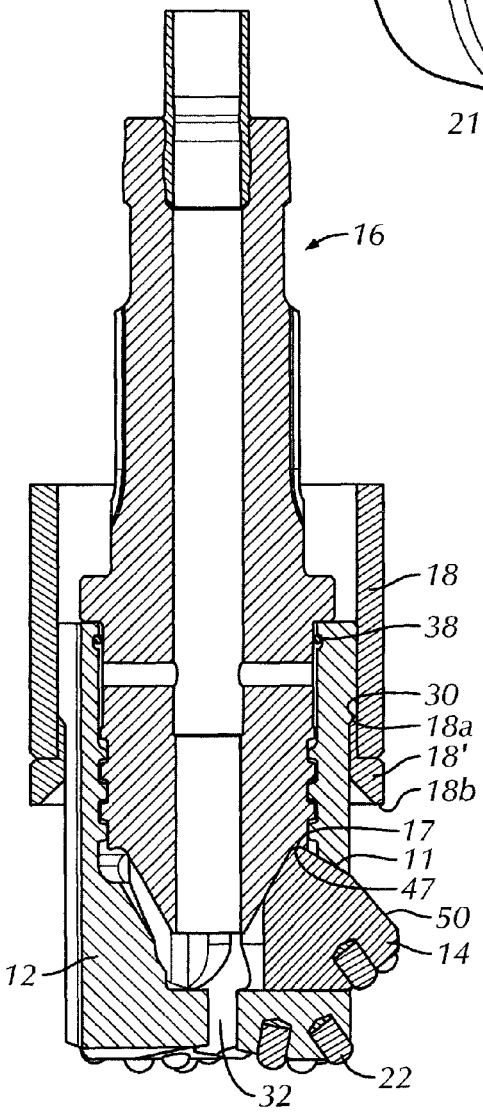
FIG. 3 is a cross-sectional elevational view of the drill stem and extendable drill bit assembly of FIG. 2.

Referring to FIGS. 1-3, the down-the-hole drill hammer assembly includes the extendable drill bit assembly 10 and a drill stem 16. The drill stem 16 is at least partially housed within the housing 2 while a pilot drill bit of the extendable drill bit assembly 10 is configured completely external to the housing 2. In general, the extendable drill bit assembly 10 and drill stem 16 of the present invention can be used with and adapted to be compatible with conventional percussive DHD hammer technologies.

The extendable drill bit assembly 10 includes a pilot drill bit 12 that is mounted to a distal end of the drill stem 16 and a drilling lug segment 14. The extendable drill bit assembly 10 is configured such that one or more, and preferably three drilling lug segments 14 move between an initial configuration (i.e., a first position, also referred to as an inward retracted position) and an extended configuration (i.e., a second position or an outwardly extending position) such that in the initial configuration the extendable drill bit assembly can pass through a casing 18. In the initial configuration, the drilling lug segment 14 is substantially within the pilot drill bit and in the extended configuration, the drilling lug segment is extended radially outwardly through an opening 28 of a lateral wall of the pilot drill bit 12, as further discussed below.

Figure 2A:
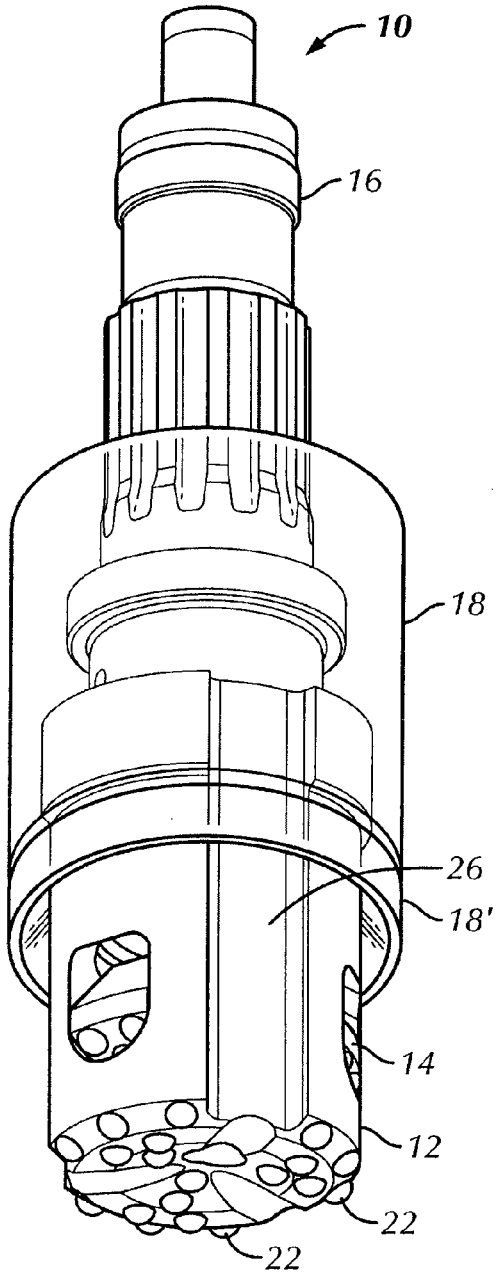
FIG. 2A is a perspective view of the drill stem and the extendable drill bit assembly of FIG. 2 in an initial configuration.

Once the extendable drill bit assembly has sufficiently passed through the bottom end of the casing 18, the drilling lug segments can be moved from the initial configuration (FIG. 2A) to the extended configuration (FIG. 2) such that the drilling lug segments extend beyond the outer periphery or outer diameter of the pilot drill bit 12 and the casing 18.

Figure 4:
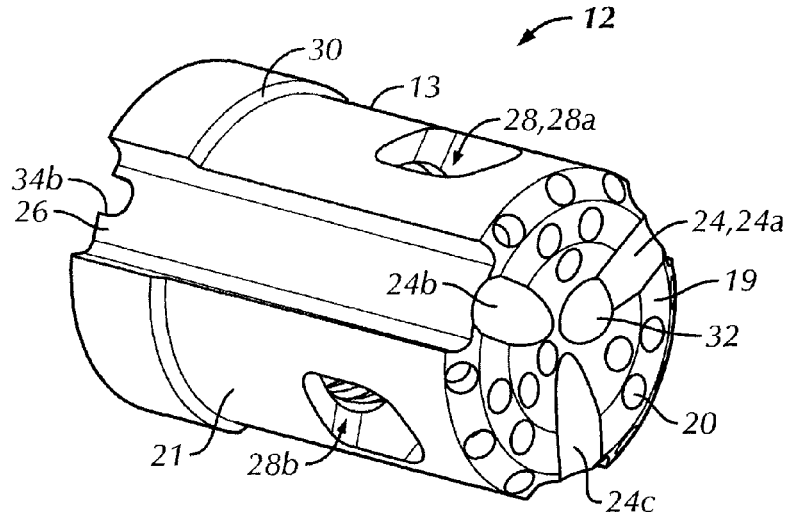
FIG. 4 is a bottom perspective view of a pilot drill bit of the extendable drill bit assembly of FIG. 2.
Figure 4A:
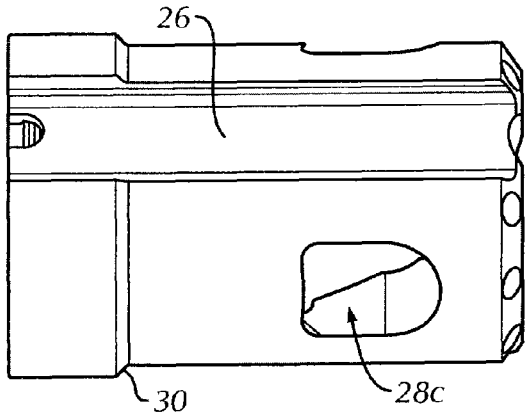
FIG. 4A is a side elevational view of the pilot drill bit of FIG. 4.
Figure 4B:
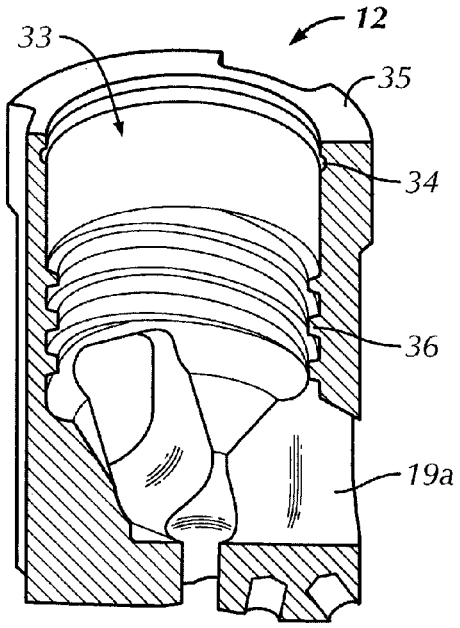
FIG. 4B is a top, perspective, cross-sectional view of the pilot drill bit of FIG. 4.
Figure 4D:
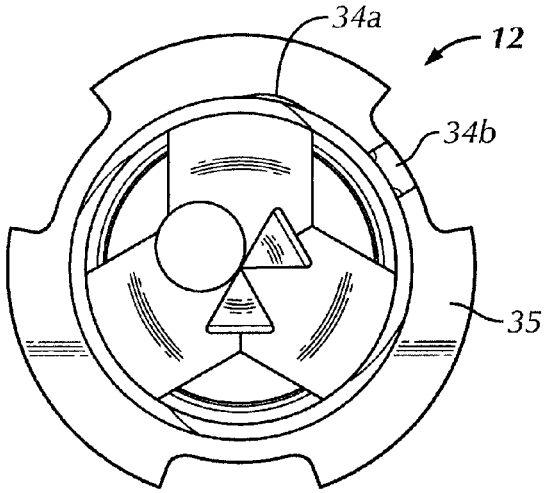
FIG. 4D is a top plan view of the pilot drill bit of FIG. 4.

The pilot drill bit 12 is configured, as best shown in FIGS. 2 and 4-4D. In general, the pilot drill bit 12 has a cylindrical body 13 having an open proximal end 15, a hollow interior 33 for receiving a distal end segment of the drill stern, and a distally facing wall segment or cutting face 19 (FIG. 4). A lateral side wall 21 extends between the distally facing wall segment 19 and a thrust surface 35 proximate the open proximal end 15. The distally facing wall segment includes a plurality of recesses 20 distributed about its distal face for receiving a plurality of cutting inserts 22 (FIG. 2) and a proximally facing inner surface 19*a* (or bottom inner surface of the distally facing wall segment) having a surface profile that is complementary in shape to the bottom surface geometry of the drilling lug segment. The structure and operation of the cutting inserts 22 are well known in the art, and therefore a detailed description of their structure and operation is not necessary for a complete understanding of the present invention.

The distally facing wall segment of the pilot drill bit 12 also includes at least one radially extending groove 24. The groove 24 extends from about a central axis of the pilot drill bit 12 radially outwardly. Preferably, the pilot drill bit 12 is configured with three radially extending grooves 24*a*-*c* that are circumferentially and equally spaced apart. About the center of the distal face of the pilot drill bit is an opening 32 that extends through the distally facing wall segment 19. The opening 32 allows for exhaust gases to be expelled from the down-the-hole drill hammer assembly about the distal face of the extendable drill bit assembly.

The pilot drill bit 12 further includes an externally facing groove 26. The groove 26 extends along the outer lateral side wall of the pilot drill bit substantially from the distally facing wall segment to the thrust surface of the pilot drill bit. The groove 26 is recessed within the lateral side wall of the pilot drill bit 12. Preferably, the pilot drill bit include three grooves that are circumferentially and equally spaces apart and extend in the axial direction.

Furthermore, the pilot drill bit 12 includes a radially outwardly extending flange 30 about its proximal end. As shown in FIG. 2, the flange 30 is configured to engage a radially inwardly extending flange 18*a* of the casing 18. The engagement of the flange 30 with the flange 18*a* registers a stop for the extension of the DHD hammer assembly through the casing's distal end.

Referring to FIGS. 2, 2A, 4 and 4A, the lateral side wall 21 of the pilot drill bit 12 includes an opening or lug port 28 that extends completely through the lateral side wall. The opening 28 is configured to slidably house the drilling lug segment 14. In other words, the opening 28 has the drilling lug segment positioned therein i.e., the drilling lug segment is housed partially within the opening. The opening 28 is configured to substantially match the overall outer profile of the drilling lug segment 14 about its coronal plane, as further described below. The opening 28 is partially formed by the proximally facing inner surface 19*a* of the pilot drill bit and an angled or sloped surface 11 that is sloped relative to a longitudinal axis of the pilot drill bit. Preferably, the sloped surface is sloped in the same direction as that of a convex curved anterior portion 48 of the drilling lug bit, as further describe below.

Preferably, the pilot drill bit 12 includes three openings 28*a*-*c* that are circumferentially and equally spaced apart. Furthermore, the pilot drill bit 12 is preferably configured with the three grooves 26 that extend along the lateral side wall of the pilot drill bit 12 between pairs of openings, such as 28*a*, 28*b*, as shown in FIG. 2.

Figure 7:
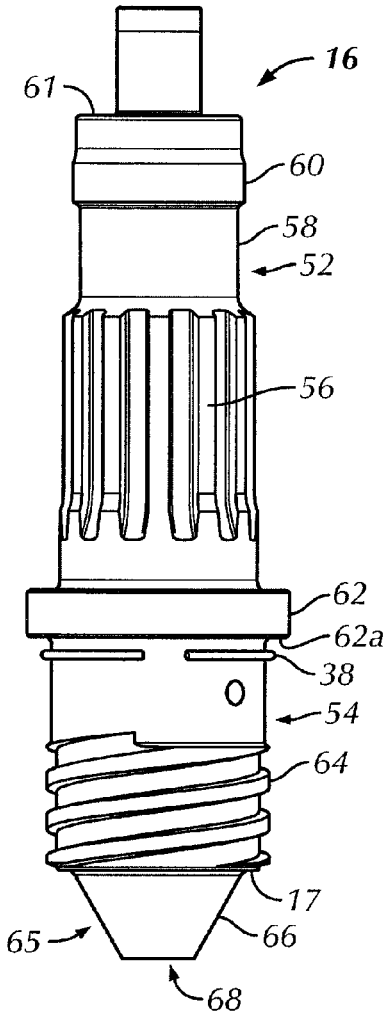
FIG. 7 is a side elevational view of the drill stem of FIG. 2 without the extendable drill bit assembly.

Referring to FIG. 4B, the pilot drill bit 12 includes threads 36 about a mid-portion of the internal side wall of the pilot drill bit 12 that extends distally and slightly past the openings 28*a*-*c*. The openings 28*a*-*c* are positioned about a distal end of the pilot drill bit 12. The threads 36 are configured to receive corresponding threads 64 on the drill stem 16, as shown in FIG. 7 and further described below.

Figure 5:
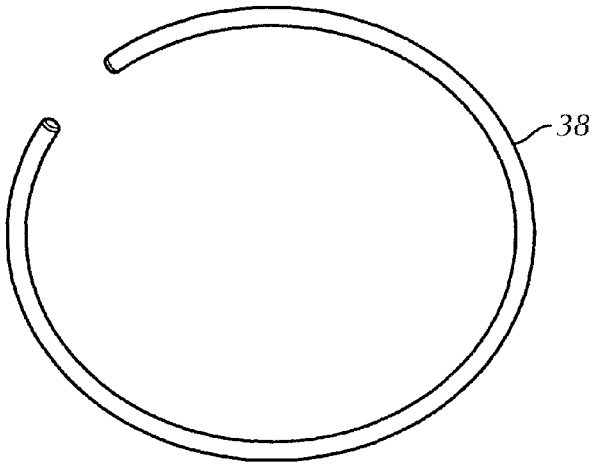
FIG. 5 is a perspective view of a retaining element of the DHD hammer assembly of FIG. 2.

The pilot drill bit 12 further includes a retaining element 38 (FIG. 5) mounted to one of the pilot drill bit and the drill stem, and positioned between the pilot drill bit and the drill stem to prevent the drill stem from completely withdrawing from the pilot drill bit. Preferably the retaining element 38 is configured about the interior of the pilot drill bit proximate the thrust surface 35. This is accomplished by a circumferential recess 34 about the interior surface of the pilot drill bit and proximate the open proximal end. The circumferential recess is configured to receive and mount the retaining element 38. The retaining element is preferably configured as a split ring 38. In general, the circumferential recess 34 houses the split ring 38, which serves as a retaining means for securing the pilot drill bit 12 to the drill stem 16. That is, the split ring 38 prevents the pilot drill bit 12 from unintentionally unthreading and completely withdrawing from the drill stem 16.

Figure 4C:
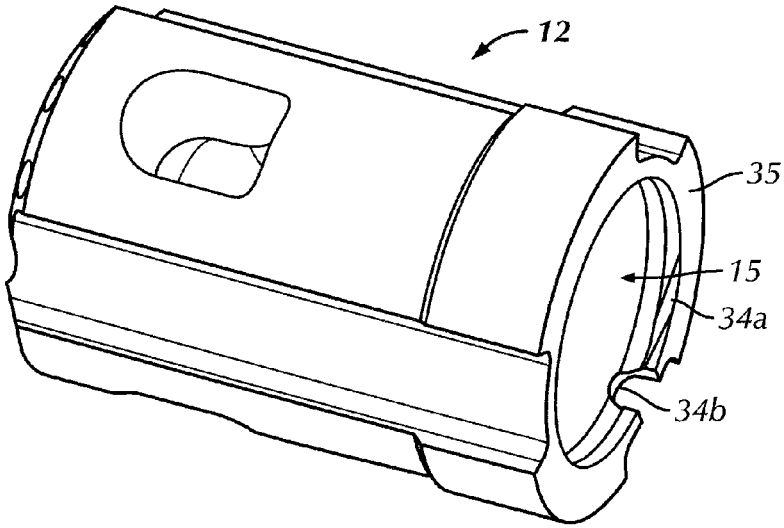
FIG. 4C is a top perspective view of the pilot drill bit of FIG. 4.

By way of example, the split ring 38 can be assembled to the drill stem 16 once the drill stem and split ring are initially coupled e.g., as shown in FIG. 1. At this point, a first end of the split ring is fed into a helical groove 34*a* formed on the internal wall of the pilot drill bit 12 (FIGS. 4C and 4D). Access to the helical groove 34*a* for feeding the first end of the split ring is provided at the point where the helical groove 34*a* breaks through the thrust surface 35 on the proximal end of the pilot drill bit 12 (FIG. 4D). The helical groove 34*a* communicates with the circumferential recess 34 thereby directing the split ring into the circumferential recess as the split ring is fed into the pilot drill bit. The proper positioning of the split ring 38 within the annular recess 34 can be checked via an access port 34*b*. The split ring 38 prevents the unintentional unthreading and disconnection of the pilot drill bit from the drill stem by engaging an abutment on the drill stem, such as threads 64.

Removal of the split ring 38 from the circumferential recess 34 can be accomplished through the access port 34*b*. To remove the split ring, the access port 34*b* is rotated and aligned with the ends of the split ring, such that one end of the split ring is visible. The visible end of the split ring is then pried upward into the helical groove 34*a* and urged out of the pilot drill bit 12. Once the split ring is removed, the pilot drill bit can be completely disengaged/withdrawn from the drill stem.

The drilling lug segment 14 is configured, as best shown in FIGS. 6A-6C and 9. The drilling lug segment 14 includes a curved distally facing bottom surface 40 that slidably engages with the proximally facing inner surface 19*a* of the opening 28. The drilling lug segment 14 also includes a proximal end portion have a convex apex thrust surface 47. The convex apex thrust surface 47 directly engages the drill stem 16 during drilling operations thereby directly transferring impact forces from the drill stem to the drilling lug segment. As further described below, when the extendable drill bit assembly is in the extended configuration, the convex apex thrust surface is directly engaged with a thrust shoulder 17 (also referred to as an abutment surface) of the drill stem 16.

The drilling lug segment 14 also includes a convex curved anterior portion 48 that extends downwardly from the convex apex thrust surface 47 forming a tapered proximal surface 48 that corresponds to the sloped surface 11 of the opening 28 on the lateral side wall of the pilot drill bit. A convex curved external portion 50 further extends from the convex curved anterior portion 48 and at a further downwardly directed angle. Extending from the convex apex thrust surface 47 in the posterior and distal direction is a concave curved surface 44. The contour of the concave curved surface 44 corresponds to the frustroconically shaped tip 66 of the drill stem to allow the drilling lug segment to slidable engage the distal end portion 65 of the drill stem via the frustroconically shaped tip. The concave curved surface 44 is preferably configured to extend about 10 to 45 degrees relative to a vertical profile of the posterior surface 42, when viewed from a side elevational perspective as shown in FIG. 6A.

Figure 6:
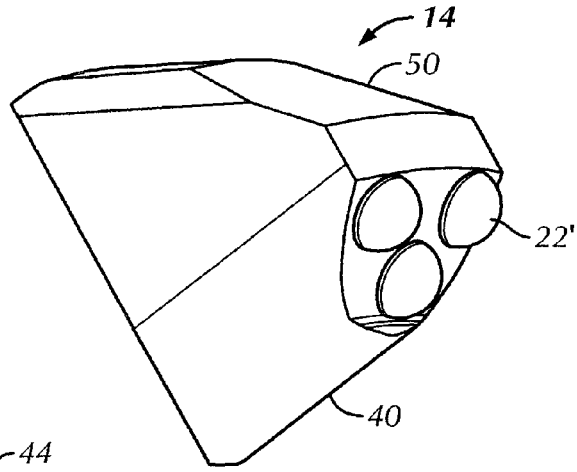
FIG. 6 is a bottom perspective view of a drilling lug segment of the extendable drill bit assembly of FIG. 2.
Figure 6A:
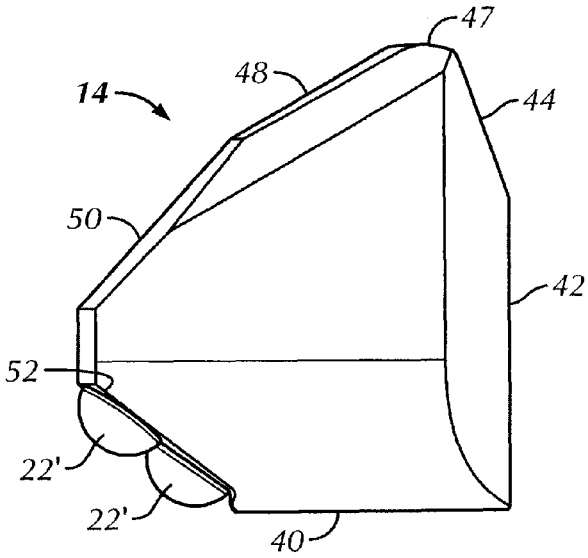
FIG. 6A is a side elevational view of the drilling lug segment of FIG. 6.

Furthermore, each drilling lug segment includes a chamfer 52 that extends upwardly and anteriorly from a horizontal surface profile of the bottom surface 40 when viewed from a side elevational perspective as shown in FIG. 6A. The chamfer 52 is configured to receive a plurality of cutting inserts 22' via cutting inserts, similarly configured on the distally facing wall segment. The cutting inserts 22' are similar to the cutting inserts 22 used in the pilot drill bit 12. The chamfer 52 represents the cutting face of the drilling lug segment 14. The length of the chamfer 52 in the horizontal direction defines the amount of increase in the effective cutting surface that the extendable drill bit 10 can provide. Preferably, the length of the chamfer 52 in the horizontal direction is about 5% to about 25% of the overall original outer diameter of the pilot drill bit 12. Preferably, the chamfer 52 is angled from about 30 to 60 degrees and more preferably about 35 degrees relative to the horizontal surface profile of the bottom surface 40 (FIG. 6A). The chamfer 52 can alternatively be configured as a curved surface sweeping in the medial-lateral direction i.e., into the page as shown in FIG. 6A.

Figure 6B:
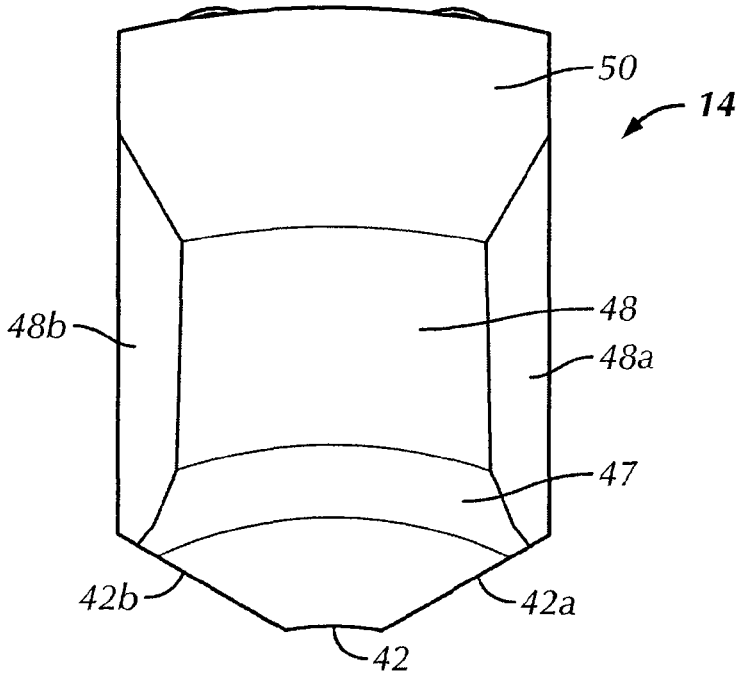
FIG. 6B is a top plan view of the drilling lug segment of FIG. 6.
Figure 6C:
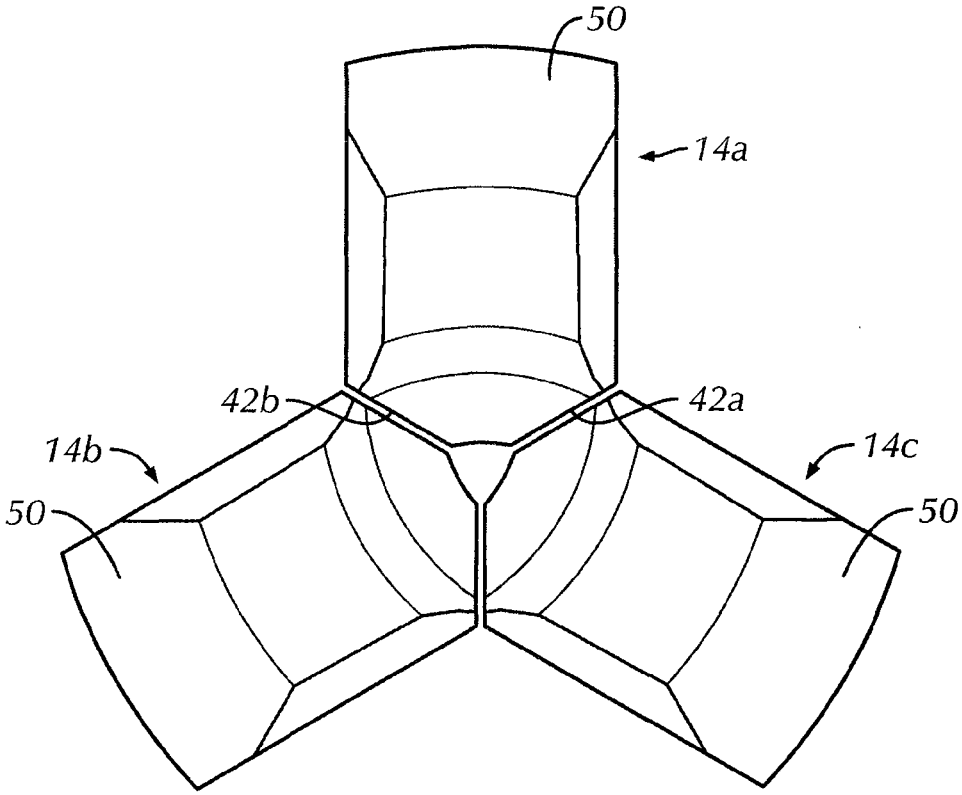
FIG. 6C is a top plan view of three drilling lug segments of FIG. 6 assembled in an initial configuration.
Figure 11:
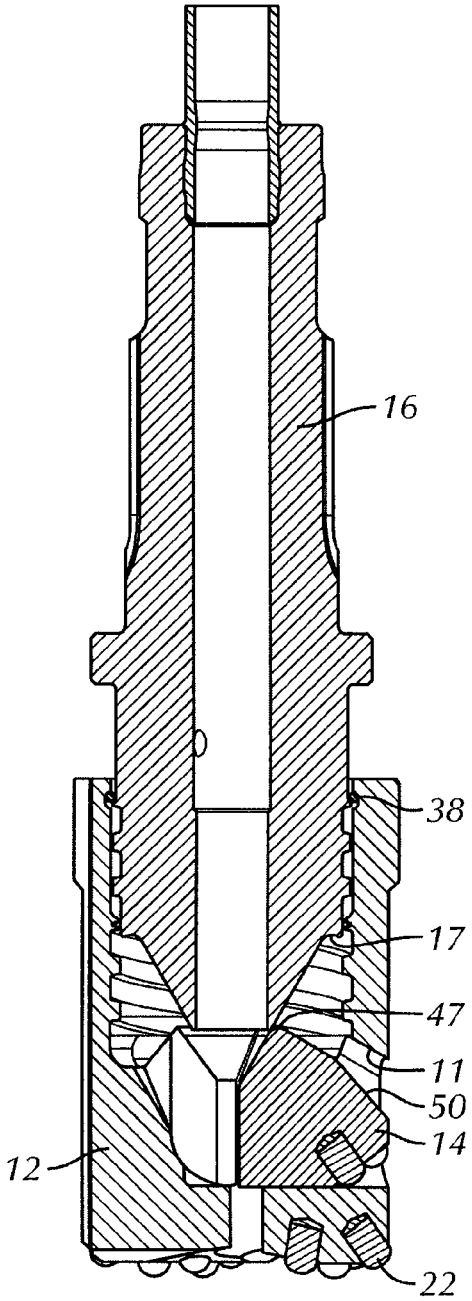
FIG. 11 is a side cross-sectional elevational view of the drill stem and extendable drill bit assembly of FIG. 2 with the drilling lug segment in an initial configuration and the drill stem in a first position.
Figure 11A:
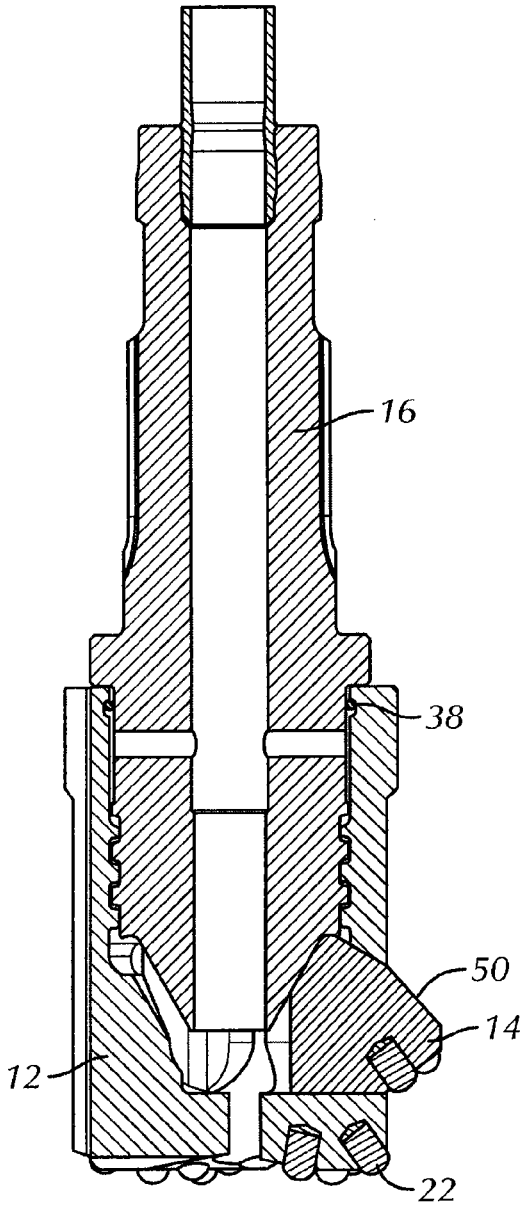
FIG. 11A is a side cross-sectional elevational view of the drill stem and extendable drill bit assembly of FIG. 11 with the drilling lug segment in an extended configuration and the drill stem in a second position.

Referring to FIG. 6B, the drilling lug segment 14 also includes chamfered side edges 48*a*, 48*b* about a proximal end portion of the drilling lug segment. In addition, as shown in FIG. 6B, the posterior side surface 42 also includes chamfered side walls 42*a*, 42*b*. The chamfered side walls 42*a*, 42*b* are angled at about 120 degrees relative to each other, such that in the initial configuration (FIG. 6C), three drilling lug segments can nest together so as to retract fully within the pilot drill bit. That is, in the initial configuration, the drilling lug segments are housed substantially completely within the pilot drill bit, as shown in FIG. 11. To be housed substantially completely within the pilot drill bit refers to the most anterior portion of the drilling lug segment being positioned to extend radially outwardly no farther than the overall outside diameter of the pilot drill bit or an inside diameter dimension of the casing 18. By way of reference, as shown in FIG. 6A, the anterior portion of the drilling lug segment 14 refers to the side that faces to the left as shown in the figure, while its posterior portion refers to the side that faces to the right as shown in the figure. Alternatively, the chamfered side walls 42*a*, 42*b* can be angled less than 120 degrees to accommodate an extendable drill bit assembly having more than three drilling lug segments.

In the extended configuration, as shown in FIG. 3, the convex curved external portion 50 and the chamfer 52 are external to the pilot drill bit. The extent to which the drilling lug segment 14 is extended in the radial direction through the opening 28 is defined by the size of the opening and the drilling lug segment. As shown in FIG. 3, in the extended configuration, the drilling lug segment is fully extended when the convex curved anterior portion 48 and the bottom surface 40 mates with the edges of the lateral side wall forming the opening 28. Plus, when in the extended configuration, the convex apex thrust surface 47 remains completely within the interior of the pilot drill bit, thereby allowing the convex apex thrust surface 47 to directly engage with the first thrust shoulder 17 of the drill stem 16.

Figure 8:
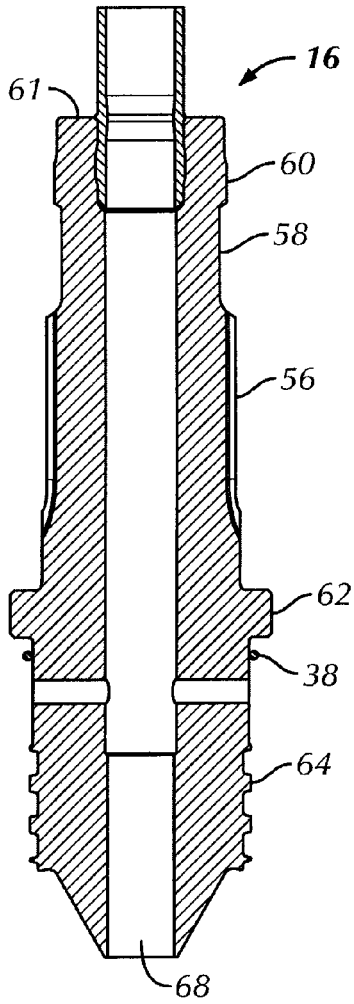
FIG. 8 is a side cross-sectional elevational view of the drill stem of FIG. 7.

FIGS. 7 and 8 illustrate the drill stem 16. The drill stem 16 includes a shank portion 52 and a distal connection end or distal end segment 54. The shank portion 52 is configured with a plurality of splines 56 circumferentially spaced apart about a distal end of the shank 52 in a mid-section of the drill stem. Above the splines 56 is a mid-section of the shank having an overall diameter that is smaller than the overall diameter of splines 56. The shank 52 also includes a proximal section 60 configured above the mid-section 58 having an overall diameter larger than the mid-section. The distal connection end 54 includes a thrust shoulder 62 (i.e., a second thrust shoulder) configured as a radially outwardly extending flange portion having an overall diameter larger than that of the splines 56. The second thrust shoulder 62 has a distally facing surface 62*a* that directly engages the thrust surface 35 of the pilot drill bit when the drill stem is fully engaged with the extendable drill bit assembly i.e., when the drilling lug segments are moved to the fully extended configuration.

The distal connection end 54 also includes a distal end portion 65. The distal end portion 65 includes an abutment surface 66 preferably in the form of a substantially frustroconically shaped about its most distal end. The frustroconically shaped tip abutment surface 66 is configured to have an angle that is complimentary to the angle and contour of the chamfer 44 on the drilling lug segments. Adjacent the frustroconically shaped abutment surface 66 is the first thrust shoulder 17. The first thrust shoulder 17 is also proximate a lateral side of the drill stem 16. The first thrust shoulder 17 acts in concert with the second thrust shoulder 62, such that when the drill stem fully engages the pilot drill bit, the first thrust shoulder 17 is engaged with the proximal end of the drilling lug segment (i.e., the convex apex thrust surface 47) and the second thrust shoulder 62 is engaged with the thrust surface 35. This combination of first and second thrust shoulders 17, 62 acting in concert advantageously allows for the direct transfer of energy from the drill stem to the extendable drill bit assembly, which includes both the pilot drill stem and the drilling lug segment. The energy of the drill stem is obtained from the percussive action of the piston impacting the drill stem's impact surface 61.

Positioned above the frustroconically shaped tip 66 are threads 64 that are configured to engage with corresponding threads 36 of the pilot drill bit 12 (see FIG. 3). The threads 64 allow the drill stem 16 to move between a first position within the pilot drill bit (FIG. 11) to a second position within the pilot drill bit (FIG. 12). As the drill stem moves from the first position to the second position, the drill stem via the frustroconically shaped tip, slidingly engages the drilling lug segment 14 and moves the drilling lug segment to the fully extended configuration. As shown in FIG. 8, the drill stem also includes an axially extending through hole 68 that extends axially through the drill stem 16.

Figure 9:
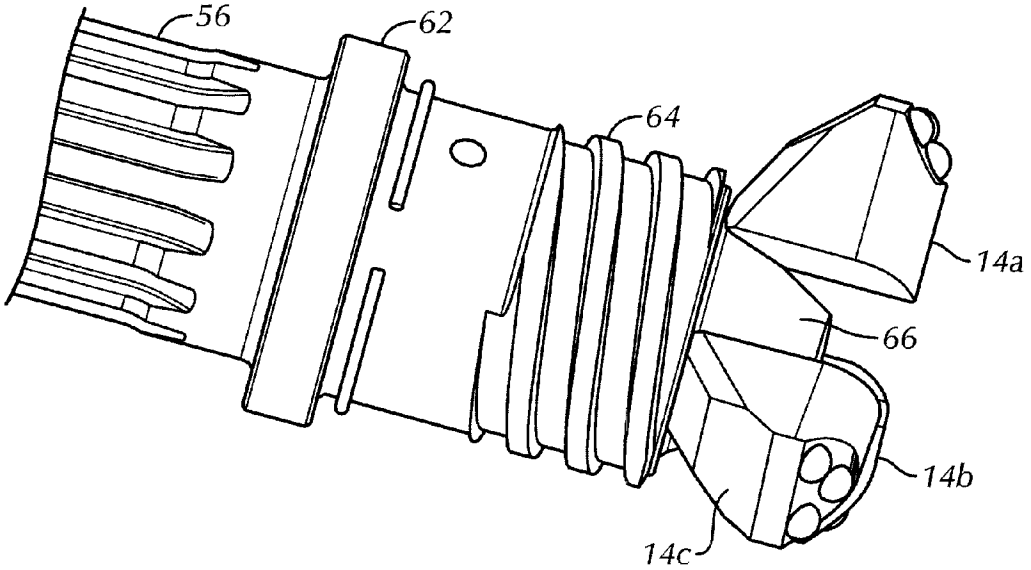
FIG. 9 is an enlarged perspective view of a distal end segment of the drill stem of FIG. 7 aligned with a plurality of drilling lug segments.

FIG. 9 illustrates the assembly of three drilling lug segments 14*a-c* along the frustroconically shaped tip 66 of the drill stem. While aligned with the frustroconically shaped tip, due to the complimentary angles of the frustroconically shaped tip and the chamfer 44, the bottom surface 40 of the drilling lug segments 14 are substantially perpendicular to a central longitudinal axis of the drill stem.

Figure 10:
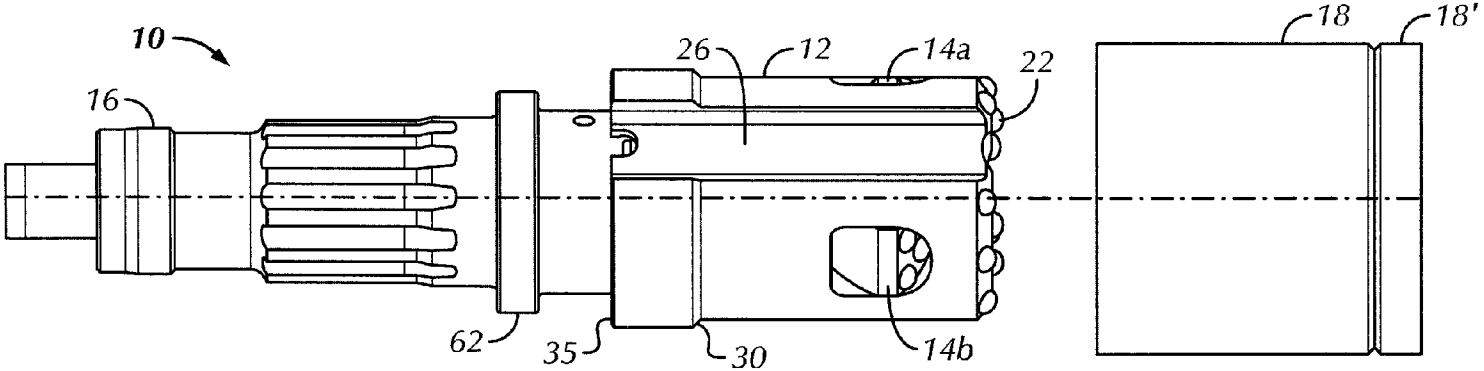
FIG. 10 is a side elevational view of the drill stem and extendable drill bit assembly of FIG. 2 in an initial position for insertion into a casing.
Figure 10A:
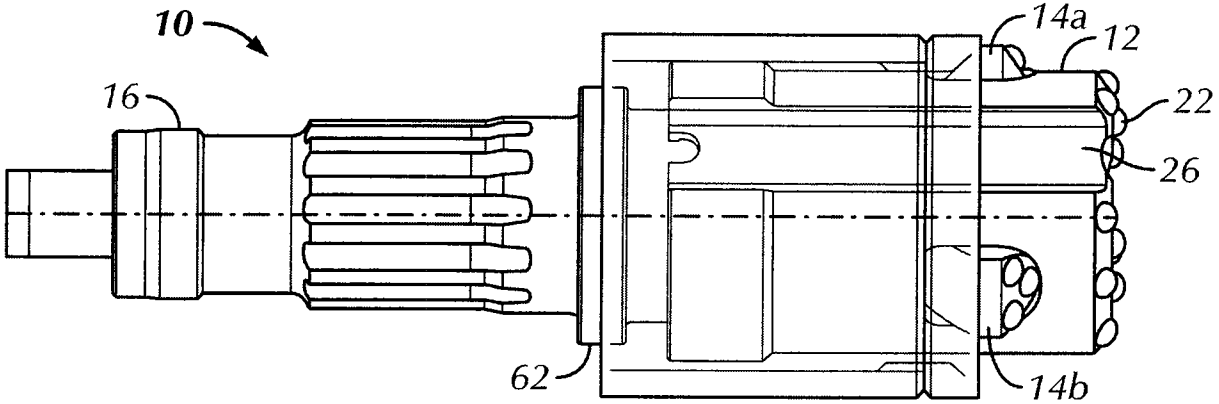
FIG. 10A is a side elevational view of the drill stem and extendable drill bit assembly of FIG. 10 partially extended through a bottom end of the casing.
Figure 10B:
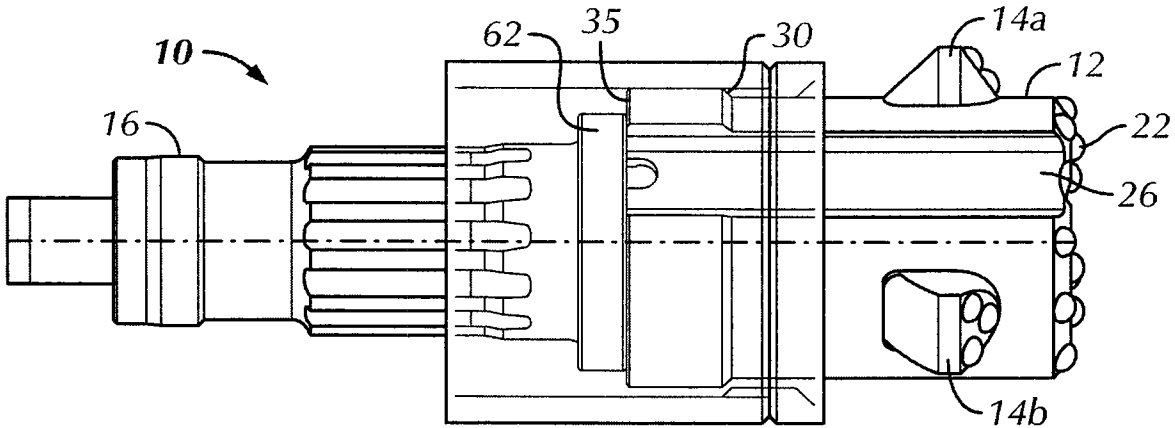
FIG. 10B is a side elevational view of the drill stem and extendable drill bit assembly of FIG. 10 extended completely through the bottom end of the casing with the drilling lug segments in an extended position.

In operation, the DHD hammer assembly of the present invention having an extendable drill bit assembly 10 is configured for use with a casing 18. In particular, the operation of the extendable drill bit assembly 10 is shown progressively in FIGS. 10-10B. In FIG. 10, the extendable drill bit assembly of the DHD hammer is shown as configured when passing through the casing 18, wherein the drill stem 16 is not fully engaged with the threads 36 of the pilot drill bit 12 such that the lug segments 14 are positioned in the initial configuration. In other words, with the lug segments 14 in the initial configuration, the extendable drill bit assembly 10 can be passed through the casing such that the pilot drill bit can extend through and beyond the bottom/distal end of the casing, as shown in FIG. 10A. After further advancement of the pilot drill bit through the casing, the flange 18*a* of the casing engages with the flange 30 of the pilot drill bit 12 to register a stop position for the extendable drill bit assembly. Thereafter, the drill stem is fully engaged with the pilot drill bit such that the threads 64 of the drill stem 16 are threaded onto the pilot drill bit 12 so as to fully seat within the pilot drill bit 12. Thus, upon advancement of the drill stem within the pilot drill bit (by tightening the engaged threads 36, 64), the distally directed movement of the frustroconically shaped tip 66 engages the chamfer 44 of drilling lug segments 14*a-c* thereby advancing the drilling lug segments 14*a-c* through the lug ports i.e., openings 28*a-c*, respectively, so as to position the drilling lug segments 14*a-c* in the extended configuration, as shown in FIG. 10B.

The advancement and rotation of the drill stem relative to the pilot bit can be accomplished by advancing the entire extendable drill bit assembly 10 against an earthen surface so as to provide frictional contact between the distal face of the pilot drill bit and the earthen surface. Thereafter, the drill stem 16 can be rotated relative to the pilot drill bit 12 to fully engage the pilot drill bit and move the drilling lug segments to the extended configuration.

Upon completion of the under reaming operation, the DHD hammer's extendable drill bit assembly 10 can be withdrawn from the bore hole by disengaging the drill stem 16 from the pilot drill bit 12. This is accomplished by a combination of counter rotation of the drill stem 16 relative to the engagement direction of the threads 36 on the pilot drill bit. Alternatively, the unlocking of the drill stem from the pilot drill bit can be accomplished by a combination of counter rotation of the drill stem relative to the pilot drill bit and light percussion of the DHD hammer. Light percussion of the DHD hammer is provided by the percussive action of a piston within the DHD hammer.

The engagement and disengagement operations of the drill stem 16 and the pilot drill bit 12 is accomplished by having a thread efficiency sufficient to allow unthreading between the threads 64 and 36. Specifically, the extendable drill bit assembly 10 is configured to have a thread efficiency of about 20% to about 40%, preferably about 25% to about 35%, and most preferably about 30%. Having such a thread efficiency percentage allows for effective disengagement between the drill stem and the pilot drill bit. That is, such thread efficiencies requires the extendable drill bit assembly to supply constant torque between the drill stem and the pilot drill bit during use, otherwise the drill stem 16 and the pilot drill bit 12 may loosen, especially in the presence of vibrations. As a result, the present invention advantageously utilizes the natural rotation applied to typical DHD hammers during drilling operations in its overall design, especially its configuration to move the drilling lug segments between the initial and extended configurations. In a preferred example, the threads 64 and 36 are configured to have a lead or helix angle of about 1.5 to 2.0 inches, preferably 1.75 inches, a flank angle of about 14 to 15 degrees, preferably 14.5 degrees, a pitch diameter of about 4.0 to 5.0 inches, preferably 4.5 inches, a mean shoulder diameter of about 4.5 to 5.0 inches, preferably about 4.75 inches, and a coefficient of friction between threads 64 and 36 of about 0.10 to 0.15, preferably about 0.13.

Upon disengagement of the drill stem 16 from the pilot drill bit 12, the drill stem is rotated so as to move proximally relative to the pilot drill bit 12 into its initial or first position. In the first position, the threads 64 of the drill stem are partially for fully disengaged with the threads 36 of the pilot drill bit 12, and the distal end of the frustroconically shaped tip 66 is further spaced apart from the distal end of the pilot drill bit 12. Thus, as shown in FIG. 11, upon the drill stem 16 being moved back into the initial position, the drilling lug segments 14*a-c* can be moved back into the initial configuration. Movement of the drilling lug segments 14*a-c* into the initial configuration is effectuated by withdrawing the DHD hammer up into the casing 18, such that a distal end surface of the casing 18*b* engages with the convex curved external portion 50 of each of the drilling lug segments 14. Thus, as the DHD hammer is withdrawn, the distal end of the casing 18*b* engages the convex curved external portion 50 thereby sliding the drilling lug segments 14*a-c* into the initial configuration and allowing the extendable drill bit assembly 10 to be further withdrawn into and out through the casing 18.

It will be appreciated by those skilled in the art that changes could be made to the embodiments described above without departing from the broad inventive concept thereof For example, additional components can be added to the drill stem and/or the extendable drill bit assembly. It is to be understood, therefore, that this invention is not limited to the particular embodiment disclosed, but it is intended to cover modifications within the spirit and scope of the present invention as discussed above.

We claim:

1. A down-the-hole drill hammer assembly comprising:
a housing;
a drill stem at least partially housed within the housing, the drill stem including:
a distal end slidably engaged with a drilling lug segment and a proximal end opposite the distal end,
an abutment surface proximate the distal end, and
a first thrust shoulder proximate the abutment surface;
wherein the drilling lug segment is movable between an initial configuration and an extended configuration, the drilling lug segment including a proximal end engageable with the first thrust shoulder; and
a pilot drill bit mounted to the drill stem, the pilot drill bit including:
an open proximal end for receiving a portion of the drill stem,
a lateral wall that includes an opening having the drilling lug segment positioned therein, and
a distal end that includes a cutting face,
wherein the drill stem is movable between first and second positions within the pilot drill bit, and in moving to the second position, the abutment surface moves toward the distal end of the pilot drill bit and engages and moves the drilling lug segment to the extended configuration.

2. The down-the-hole drill hammer assembly of claim 1, wherein the abutment surface is a substantially frustroconically shaped abutment surface and the first thrust shoulder is located adjacent the abutment surface and proximate a lateral side of the drill stem.

3. The down-the-hole drill hammer assembly of claim 2, wherein the drilling lug segment slidingly engages the abutment surface.

4. The down-the-hole drill hammer assembly of claim 1, wherein the drill stem further includes a second thrust shoulder, the pilot drill bit includes a thrust surface and in the extended configuration, the second thrust shoulder is engaged with the thrust surface and the first thrust shoulder is engaged with the proximal end of the drilling lug segment.

5. The down-the-hole drill hammer assembly of claim 1, further comprising a retaining element mounted to one of the pilot drill bit and the drill stem, and positioned between the pilot drill bit and the drill stem to prevent the drill stem from withdrawing from the pilot drill bit.

6. The down-the-hole drill hammer assembly of claim 1, wherein the drilling lug segment is housed substantially completely within the pilot drill bit in the initial configuration.

7. An extendable drill bit assembly comprising:

a pilot drill bit for mounting to a drill stem, the pilot drill bit including:

a cylindrical body, an open proximal end and a hollow interior for receiving a distal end segment of the drill stem, a thrust surface proximate the open proximal end, a distally facing wall segment having:

a plurality of cutting inserts, and a proximally facing inner surface, and a lateral wall extending between the thrust surface and the distally facing wall segment having an opening partially formed by the proximally facing inner surface and a sloped surface that is sloped relative to a longitudinal axis of the pilot drill bit; and a drilling lug segment partially housed within the opening and moveable between a first position substantially within the pilot drill bit and a second extended position extending radially outwardly through the opening of the lateral wall of the pilot drill bit, the drilling lug segment having:

a curved distally facing surface slidably engaged with the proximally facing inner surface of the distally facing wall segment, a proximal end portion having a convex apex thrust surface for engaging a thrust shoulder of the drill stem, and a correspondingly sloped proximal surface that engages the sloped surface of the opening of the lateral wall.

8. The extendable drill bit assembly of claim 7, wherein in the second position, the convex apex thrust surface is positioned within the hollow interior of the pilot drill bit.

9. The extendable drill bit assembly of claim 7, wherein the pilot drill bit further comprises a retaining element mounted to an interior surface of the pilot drill bit proximate the thrust surface.

10. The extendable drill bit assembly of claim 9, wherein the pilot drill bit includes a circumferential recess about the interior surface of the pilot drill bit for mounting the retaining element.

11. The extendable drill bit assembly of claim 9, wherein the retaining element is a split ring.

12. The extendable drill bit assembly of claim 7, wherein the lateral wall of the pilot drill bit comprising three openings and the expandable drill bit comprises three drilling lug segments.

13. The extendable drill bit assembly of claim 7, wherein the lateral wall of the pilot drill bit further comprises an externally facing groove extending substantially from the distally facing wall segment to the proximally facing thrust surface.

14. A down-the-hole drill hammer assembly comprising:

a housing;

a drill stem partially housed within the housing, the drill stem including:

a distal end slidably engaged with a drilling lug segment and a proximal end opposite the distal end, an abutment surface proximate the distal end, wherein the abutment surface is at a non-parallel angle relative to a longitudinal axis of the housing, and a first thrust shoulder proximate the abutment surface;

wherein the drilling lug segment is movable between an initial configuration and an extended configuration, the drilling lug segment including a proximal end engageable with the first thrust shoulder; and a pilot drill bit mounted to the drill stem, the pilot drill bit including:

an open proximal end for receiving a portion of the drill stem, and a lateral wall that includes an opening having the drilling lug segment positioned therein, wherein the abutment surface is movable between first and second positions within the pilot drill bit, and in moving to the second position, the drill stem moves the drilling lug segment to the extended configuration.

15. The down-the-hole drill hammer assembly of claim 14, wherein the abutment surface is a substantially frustroconically shaped abutment surface.

16. The down-the-hole drill hammer assembly of claim 14, wherein the drilling lug segment slidingly engages the abutment surface.

17. The down-the-hole drill hammer assembly of claim 14, wherein the drill stem further includes a second thrust shoulder, the pilot drill bit includes a thrust surface and in the extended configuration, the second thrust shoulder is engaged with the thrust surface and the first thrust shoulder is engaged with the proximal end of the drilling lug segment.

18. The down-the-hole drill hammer assembly of claim 14, further comprising a retaining element mounted to one of the pilot drill bit and the drill stem, and positioned between the pilot drill bit and the drill stem to prevent the drill stem from withdrawing from the pilot drill bit.

19. The down-the-hole drill hammer assembly of claim 14, wherein the drilling lug segment is housed substantially completely within the pilot drill bit in the initial configuration.

20. A down-the-hole drill hammer assembly comprising:

a housing;

a drill stem at least partially housed within the housing, the drill stem including:

a distal end slidably engaged with a drilling lug segment and a proximal end opposite the distal end, a substantially frustroconically shaped abutment surface proximate the distal end, and a first thrust shoulder closer to the proximal end than the abutment surface and located adjacent the abutment surface and proximate a lateral side of the drill stem, wherein the drilling lug segment is movable between an initial configuration and an extended configuration, the drilling lug segment including a proximal end engageable with the first thrust shoulder; and a pilot drill bit mounted to the drill stem, the pilot drill bit including:

an open proximal end for receiving a portion of the drill stem, and a lateral wall that includes an opening having the drilling lug segment positioned therein, wherein the drill stem is movable between first and second positions within the pilot drill bit, and in moving to the second position, the abutment surface engages and moves the drilling lug segment to the extended configuration.

* * * * *